US012157650B2

(12) United States Patent
Segal et al.

(10) Patent No.: US 12,157,650 B2
(45) Date of Patent: Dec. 3, 2024

(54) FLUID FLOW WEB TENSION DEVICE FOR ROLL-TO-ROLL PROCESSING

(71) Applicant: Core Flow Ltd., Daliyat el-Karmel (IL)

(72) Inventors: Alon Segal, Kiriyat Tivon (IL); Yaacov Legerbaum, Haifa (IL); Eric Joeli, Misgav (IL); Ronen Lautman, Haifa (IL)

(73) Assignee: Core Flow Ltd., Daliyat el-Karmel (IL)

( * ) Notice: Subject to any disclaimer, the term of this patent is extended or adjusted under 35 U.S.C. 154(b) by 664 days.

(21) Appl. No.: 17/437,008

(22) PCT Filed: Mar. 8, 2020

(86) PCT No.: PCT/IL2020/050266
§ 371 (c)(1),
(2) Date: Sep. 7, 2021

(87) PCT Pub. No.: WO2020/183452
PCT Pub. Date: Sep. 17, 2020

(65) Prior Publication Data

US 2022/0177249 A1 Jun. 9, 2022

Related U.S. Application Data

(60) Provisional application No. 62/816,226, filed on Mar. 11, 2019.

(51) Int. Cl.
*B65H 23/24* (2006.01)
*B65H 23/26* (2006.01)

(52) U.S. Cl.
CPC ..... *B65H 23/24* (2013.01); *B65H 23/26* (2013.01); *B65H 2406/111* (2013.01); *B65H 2406/113* (2013.01)

(58) Field of Classification Search
CPC ..... B65H 23/16; B65H 23/26; B65H 23/24; B65H 23/48; B65H 23/0212;
(Continued)

(56) References Cited

U.S. PATENT DOCUMENTS 3,261,523 A * 7/1966 Roecks ..... G11B 15/38 226/186
3,531,035 A 9/1970 Maynard et al.
(Continued)

FOREIGN PATENT DOCUMENTS

CN 1705606 12/2005
EP 2925684 10/2015
(Continued)

OTHER PUBLICATIONS

International Search report for PCT application No. PCT/IL2020/050266 mailed on Jun. 21, 2020.

*Primary Examiner* — Michael R Mansen
*Assistant Examiner* — Katelynne R Burrell
(74) *Attorney, Agent, or Firm* — PEARL COHEN ZEDEK LATZER BARATZ LLP

(57) ABSTRACT

A web tension device includes a pressure source and a stationary housing. A translatable unit is translatable into and out of a cavity of the housing and includes an inlet that is connectable to the pressure source. A distal end of the translatable unit includes a tensioning surface with openings to enable outflow of pressurized fluid to apply a pushing force to a web in a roll-to-roll process. Proximal openings enable outflow of the fluid into a gap between the housing and the translatable unit. When tension of the web is reduced, an outward force that is exerted by pressure in the gap pushes the translatable unit outward, pushing the web outward until an inward force that is exerted by the web balances the outward force. When tension of the web increases, the inward force pushes the translatable unit
(Continued)

inward until the inward force is balanced by the outward force.

4 Claims, 3 Drawing Sheets

(58) Field of Classification Search
CPC ..... B65H 2406/13; B65H 2406/111; B65H 2406/113; B65H 2406/11325; B65H 59/36; B41F 21/102; B65G 2207/06
USPC ..... 242/417.1, 414, 417.3, 419.3; 226/95, 226/97.3, 615.11, 615.12
See application file for complete search history.

(56) References Cited

U.S. PATENT DOCUMENTS 3,540,671 A * 11/1970 Moehle ..... B65H 23/24 242/548.1
3,740,205 A * 6/1973 Cayphas et al. ..... C03B 15/18 65/196
5,423,468 A * 6/1995 Liedtke ..... B65H 23/24 242/615.12
6,572,095 B1 * 6/2003 Katou ..... H04N 1/00618 346/138
7,311,234 B2 * 12/2007 Solberg ..... B65H 23/24 226/193
8,397,539 B2 * 3/2013 Chang ..... B65G 49/065 65/25.2
9,914,610 B2 3/2018 Mabuchi et al.
2005/0098680 A1 5/2005 Naruoka et al.
2011/0135405 A1 * 6/2011 Miyaji ..... B65H 23/24 406/70
2011/0198378 A1 8/2011 Chang et al.

FOREIGN PATENT DOCUMENTS

JP 60082563 A * 10/1983 ..... B65H 23/34
JP 2012526034 A * 10/2012 ..... B65H 27/00
JP 2017-036146 9/2020
WO WO2005/021866 3/2005
WO WO2013/065249 5/2013
WO WO-2017161104 A1 * 9/2017

* cited by examiner

FLUID FLOW WEB TENSION DEVICE FOR ROLL-TO-ROLL PROCESSING

CROSS-REFERENCE TO RELATED APPLICATIONS

This application is a U.S. National Phase Application of PCT International Patent Application No. PCT/IL2020/050266 International Filing Date Mar. 8, 2020, claiming the benefit of U.S. Patent Application No. 62/816,226, filed Mar. 11, 2019, which are hereby incorporated by reference.

FIELD OF THE INVENTION

The present invention relates to roll-to-roll processes. More particularly, the present invention relates to a web tension device for roll-to-roll processing based on fluid flow.

BACKGROUND OF THE INVENTION

In roll-to-roll processes, a flexible thin substrate, or web, is fed into a processing region by an input roll, processed, and then removed from the processing region via an output roll. In some cases, the web may be unwound from the input roll and wound onto the output roll.

For example, processing on the web may include printing (e.g., electronic circuitry), coating, laminating, or other processing. Typically, the processed web is cut into separate sheets either as being wound onto the output roll, or afterward. As another example, processing may include application of ink to the web at one point, and transferring the ink from the web to paper at another point.

SUMMARY OF THE INVENTION

There is thus provided, in accordance with an embodiment of the present invention, a web tension device including: a pressure source of pressurized fluid; a stationary housing; a translatable unit that is translatable into and out of a cavity of the housing, the translatable unit including an inlet that is connectable to the pressure source to enable the pressurized fluid to flow into the translatable unit, a distal end of the translatable unit including a tensioning surface with one or a plurality of tensioning pressure openings to enable outflow of the pressurized fluid to form a fluidic cushion, the fluidic cushion to apply a pushing force to a web in a roll-to-roll process; and one or a plurality of proximal pressure openings to enable outflow of the pressurized fluid into a gap between the housing and a proximal end of the translatable unit such that when a tension of the web is reduced, an outward force that is exerted on the proximal end by pressure of the fluid in the gap pushes the translatable unit outward to push the web outward until an inward force that is exerted on the translatable unit by the web balances the outward force, and when the tension of the web is increased, the inward force pushes the translatable unit inward until the inward force is balanced by the outward force.

Furthermore, in accordance with an embodiment of the present invention, at least one of the one or plurality of proximal pressure openings is located on the translatable unit.

Furthermore, in accordance with an embodiment of the present invention, the at least one of the one or plurality of proximal pressure openings is located on a proximal face of the translatable unit.

Furthermore, in accordance with an embodiment of the present invention, a floor of the cavity that is opposite the proximal face is impermeable to the fluid.

Furthermore, in accordance with an embodiment of the present invention, the device includes one or a plurality of lateral pressure openings that are configured to maintain a clearance between a lateral face of the translatable unit and a wall of the cavity that is opposite that wall.

Furthermore, in accordance with an embodiment of the present invention, at least one of the one or plurality of lateral openings is located on a lateral face of the translatable unit.

Furthermore, in accordance with an embodiment of the present invention, at least one of the one or plurality of lateral pressure openings is located on an inward facing surface of a lateral wall of the cavity.

Furthermore, in accordance with an embodiment of the present invention, the tensioning surface is convex.

Furthermore, in accordance with an embodiment of the present invention, the fluidic cushion is configured to apply the pushing force by pushing on the web.

Furthermore, in accordance with an embodiment of the present invention, the tensioning surface is cylindrically convex.

Furthermore, in accordance with an embodiment of the present invention, the tensioning surface is concave.

Furthermore, in accordance with an embodiment of the present invention, the device includes a roller, the fluidic cushion configured to suspend the roller.

Furthermore, in accordance with an embodiment of the present invention, the fluidic cushion is configured to apply the pushing force by pushing the suspended roller into the web.

Furthermore, in accordance with an embodiment of the present invention, the tensioning surface is cylindrically concave and wherein the roller is cylindrical.

Furthermore, in accordance with an embodiment of the present invention, the fluid includes air.

Furthermore, in accordance with an embodiment of the present invention, at least one of the one or plurality of proximal pressure openings is located on a floor of the cavity.

Furthermore, in accordance with an embodiment of the present invention, a proximal face of the translatable unit that is opposite the floor of the cavity is impermeable to the fluid.

BRIEF DESCRIPTION OF THE DRAWINGS

In order for the present invention to be better understood and for its practical applications to be appreciated, the following Figures are provided and referenced hereafter. It should be noted that the Figures are given as examples only and in no way limit the scope of the invention. Like components are denoted by like reference numerals.

DETAILED DESCRIPTION OF THE INVENTION

Figure 1:
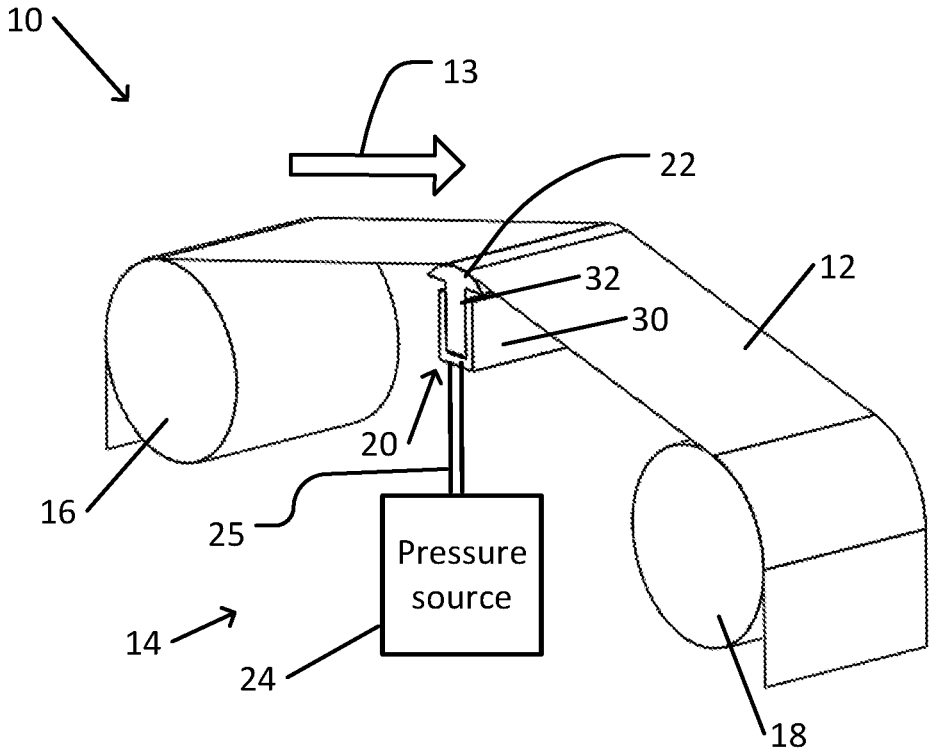
FIG. 1 schematically illustrates an example of a roll-to-roll system with a web tension device.

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

Although embodiments of the invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulates and/or transforms data represented as physical (e.g., electronic) quantities within the computer's registers and/or memories into other data similarly represented as physical quantities within the computer's registers and/or memories or other information non-transitory storage medium (e.g., a memory) that may store instructions to perform operations and/or processes. Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method embodiments described herein are not constrained to a particular order or sequence. Additionally, some of the described method embodiments or elements thereof can occur or be performed simultaneously, at the same point in time, or concurrently. Unless otherwise indicated, the conjunction "or" as used herein is to be understood as inclusive (any or all of the stated options).

In accordance with an embodiment of the invention, a web tension device is configured to utilize controlled fluid pressure to maintain the tension in a web in a roll-to-roll process. A translatable unit of the device includes a distal tensioning surface that is translatable toward or away from a portion of the web that is currently between the input and output rollers. The tensioning surface includes one or a plurality of distal pressure openings to form a fluidic cushion that is configured to apply a pushing force to the web. For example, the tensioning surface may be convex, with the fluidic cushion configured to push directly against the web. In another example, the tensioning surface may be concave, with a roller that is supported by the fluidic cushion and that is configured to press against the web.

The translatable unit is translatable into and out of a stationary housing. One or more proximal pressure openings are configured to maintain a fluid pressure between a proximal end of the translatable unit and the housing. The proximal pressure openings may be located on the translatable unit or on the housing. An equilibrium position of the translatable unit is determined by the fluid pressure of fluid (e.g., air, or another gas or fluid) that is expelled via proximal ports within a cavity of the housing that at least partially surrounds the translatable unit, and by a current tension in the web. An equilibrium position of the translatable unit relative to the housing is determined by a point when the tension in the web, applying a force to push the translatable unit toward the housing, is balanced by the pressure in the fluid that applies the force to push the translatable unit out of the housing. For example, an increase in web tension may cause the translatable unit to be retracted into the housing, thus enabling the web tension to relax. A decrease in web tension may cause the translatable unit to extend further out of the housing, thus increasing the web tension.

In many processes, the web must be maintained at a predetermined tension. In some applications, a disturbance at one location on the web, e.g., due to a processing step, may result in a change in web tension at another location. Compensation for this change in tension may be required to enable proper processing of the web. For example, in some applications, compensation for such a disturbance is to be compensated for in less than half a second, or another short period of time. In some applications, a typical compensation for the disturbance may entail local movement of the web by up to two millimeters in a direction normal to the tension (e.g., normal to the surface of the web).

For example, the web tension device may be configured such that a pressure of fluid in a gap between the translatable unit and the housing of the translatable unit is maintained at a substantially constant level. If the tension in the web is reduced, e.g., due to disturbance of the web, e.g., by applying a processing step to the web, then the pressure between the web and the tensioning surface of the translatable unit may be reduced momentarily. The inward force on the translatable unit is likewise reduced. The fluid pressure within that gap between the translatable unit and the housing may then push the translatable unit outward from the housing and toward the web. This outward translation of the translatable unit may push the web outward, thus increasing the tension of the web. The outward translation and increase in web tension may continue until the pressure of the fluid in the gap is balanced again by the tension in the web. Thus, the web tension device may counteract a decrease in web tension.

Similarly, the tension in the web may increase due to a disturbance of the web. In this cases, the increase in tension may momentarily increase the pressure between the tensioning surface and the web. The inward force applied by the web is thus similarly increased. The increased inward force may push the translatable unit into the housing, thus reducing outward pushing on the web and enabling the tension in the web to decrease. The inward motion and decrease in web tension may continue until the tension in the web is balanced by the fluid pressure in the gap between the translatable unit and the housing. Thus, the web tension device may counteract an increase in web tension.

The tensioning surface may be designed to minimize or eliminate application of friction forces to the web, e.g., so as prevent any damage the web. For example, the tensioning surface may be provided with one or a plurality of outflow openings that are distributed over the tensioning surface, e.g., in the form of a cylindrically convex surface. The outflow of fluid through the outflow openings may form a fluidic cushion that prevents direct contact of the tensioning surface with the web while applying a lateral force to the web. As another example, the tensioning surface may include a cylindrical roller. The roller may be frictionlessly suspended in air by the fluid pressure that is applied to the roller via pressure openings in a concave cylindrical surface of a translatable unit. The frictionless suspension of the roller may enable the roller to apply a lateral force to the web without applying any excessive (e.g., sufficient to cause any damage to, or affect precision in the motion of, the web) longitudinal, e.g., friction, forces to the web.

In one example, the web tension device includes a housing that includes a cavity or channel. The housing is mounted so as to remain stationary, e.g., relative to a processing facility for processing the web. For example, the housing may be mounted to a structure that is at a fixed location relative to the input roll, output roll, or other components of the roll-to-roll processing facility that are stationary relative to one another. A proximal end of the translatable unit of the web tension device is configured to fit within the cavity, and to move inward and outward relative to the cavity. The tensioning surface of the translatable unit is at a distal end of the translatable unit. For example, the tensioning surface may include a convex surface with pressure openings to form an air cushion between the tensioning surface and the web. In another example, the tensioning surface may include a concave surface with pressure openings to suspend a cylindrical roller between the tensioning surface and the web.

For example, the translatable unit may be connectable via one or more inlets to a source of fluid pressure, e.g., with a standard hose connection. The fluid may flow out of pressure openings that are distributed on one or more faces of the proximal end of the translatable unit that face interior walls of the cavity. The interior of the translational unit includes interior channels to enable the fluid to flow from the inlet to the pressure openings. Outflow of the fluid from the pressure openings may generate a fluid pressure in the space between the translatable unit and the cavity. The magnitude of this fluid pressure (e.g., related to the flowrate or pressure of the outflow) determines an outward force that is applied to the translatable unit that tends to push the translatable unit outward from the cavity. Thus, controlling the pressure of the fluid from the pressure source may determine the force that is applied to the tensioning surface, and thus the magnitude of the web tension that is to be maintained. In this example, a portion of the outflowing fluid may be directed to pressure openings on the tensioning surface, e.g., to form a fluidic cushion. The resistance to flow of the interior channels may be configured (e.g., with different diameters or widths, with different lengths, or otherwise) to maintain a predetermined ratio between rates of outflow through different sets of pressure openings, e.g., on different faces of the translatable unit.

As another example, the housing may be connectable to the source of fluid pressure. The fluid may flow out of pressure openings that are distributed along one or more interior walls of the cavity. In this example also, outflow of the fluid from the pressure openings may generate a fluid pressure in the space between the stem and the cavity walls. The magnitude of this fluid pressure determines an outward force that is applied to the stem that tends to push the translatable unit outward from the cavity. Thus, controlling the pressure of the fluid from the pressure source may determine the force that is applied to the tensioning surface, and thus determine a web tension that is to be maintained. In this example, the translatable unit may be separately connected to the same or a different source of fluid pressure to enable outflow from pressure openings on the tensioning surface at a distal end of the translatable unit.

FIG. 1 schematically illustrates an example of a roll-to-roll system with a web tension device.

Roll-to-roll system 10 is configured to enable processing on a portion of web 12 between input roll 16 and output roll 18. For example, input roll 16, output roll 18, or both may be motorized, or another roller or component of roll-to-roll system 10 may be motorized to cause web 12 in the direction indicated by web motion arrow 13. In some cases, a counterforce (e.g., to maintain tension of web 12) may be provided by gravitational pull on part or another of web 12.

Web tension system 14 is configured to automatically adjust the tension on web 12, e.g., to maintain a constant tension of web 12 when one or more factors causes the tension to deviate from a desired tension. For example, a desired tension may be selected so as to facilitate processing of web 12.

Pressurized fluid, such as a forced air flow or other type of pressurize fluid flow, may flow into web tension device 20 from pressure source 24 via fluid conduit 25. For example, pressure source 24 may include a pump, blower, tank of pressurized or liquefied gas, or another source of pressurized or forced air or gas, or another source of a pressurized liquid. In some cases, pressure source 24 may be controlled to generate an outflow at a controlled fluid pressure. In some cases, pressure source 24, fluid conduit 25, or both, may include one or more valves. The valves may be operated to control the flow of fluid into one or more components of web tension device 20, or to control the pressure of the fluid that is flowing into web tension device 20.

The pressure of the fluid that flows into web tension device 20 may determine the distance that tensioning surface 22 extends out of web tension device 20 into web 12. Typically, extending tensioning surface 22 into web 12 increases the tension of web 12, while retracting tensioning surface 22 out of web 12 may enable the tension of web 12 to decrease. Thus, controlling the pressure of the fluid that flows into web tension device 20 may maintain a particular tension of web 12.

In the example shown, tensioning surface 22 is elongated to extend across the entire width of web 12. For example, a longitudinal axis of tensioning surface 22 may be oriented perpendicular, or at an oblique angle to, the direction indicated by web motion arrow 13. In other examples, two or more tensioning surfaces, e.g., aligned collinearly or parallel to one another, or otherwise, may extend across different parts of the width of web 12. The two or more tensioning surfaces may be extended independently of one another (e.g., to apply different tensioning forces to different sections of web 12), or may be operated in tandem (either extending by the same distance, or by predetermined different distances).

Although a particular configuration of web tension device 20 is shown in FIG. 1, one or more other configurations of a web tension device as described herein may be incorporated into web tension system 14 of roll-to-roll system 10.

Figure 2:
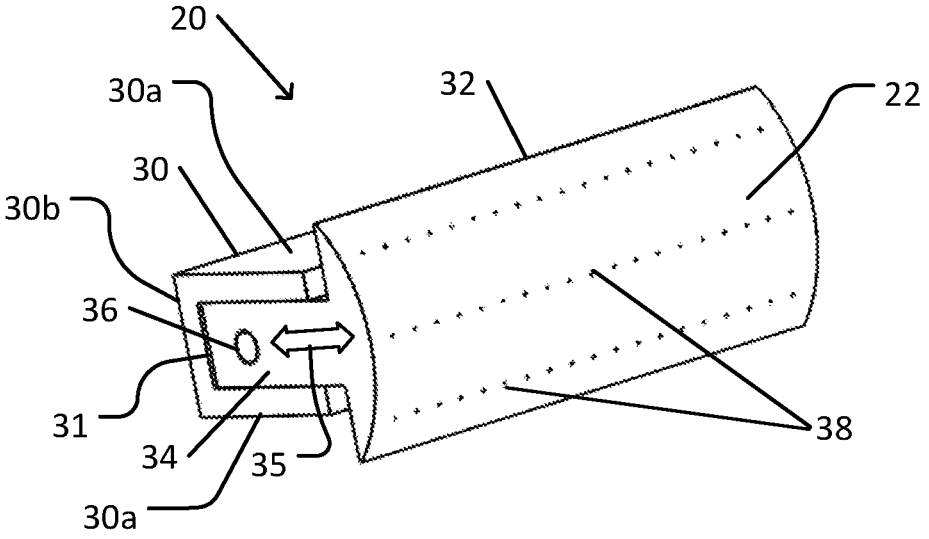
FIG. 2 schematically illustrates an example of a web tension device that includes a translatable unit with a convex tensioning surface.
Figure 3:
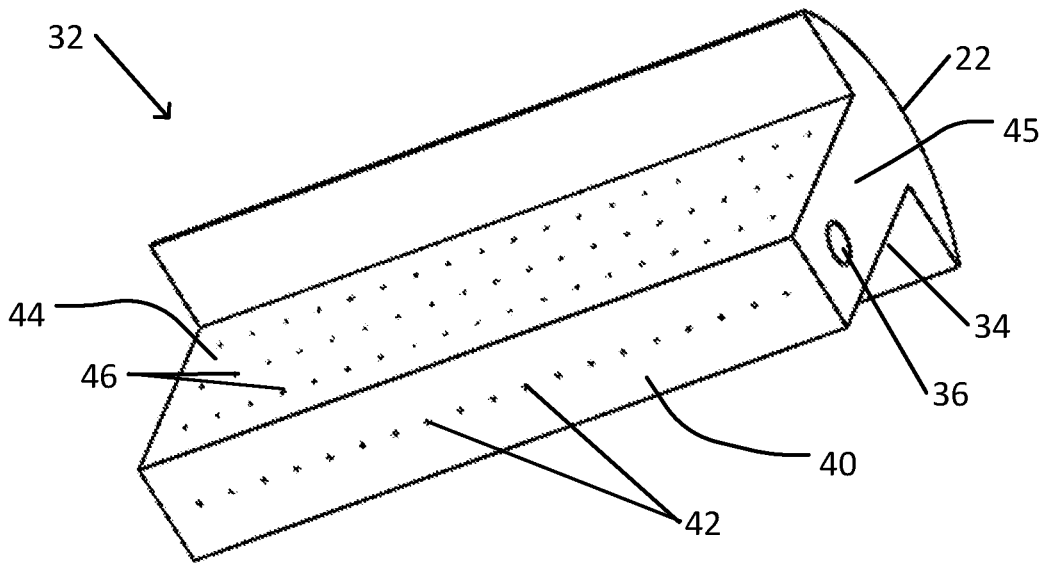
FIG. 3 schematically illustrates an example of a translatable unit of the web tension device shown in FIG. 2.

FIG. 2 schematically illustrates an example of a web tension device that includes a translatable unit with a convex tensioning surface. FIG. 3 schematically illustrates an example of a translatable unit of the web tension device shown in FIG. 2.

Web tension device 20 includes housing unit 30 and translatable unit 32. In the example shown, housing unit 30 includes a cavity 31 in the form of an elongated channel. The lateral sides and bottom of cavity 31 are enclosed by lateral walls 30*a* of housing unit 30 and by floor 30*b*, respectively. In the example shown, the ends at the extremities of the elongated direction of cavity 31 are open. In other examples, one or both of the ends may be at least partially closed. For example, a wall closing an end of cavity 31 may include a slot to enable access to pressure inlet 36 on translatable unit 32.

In the example shown, a proximal portion of translatable unit 32 includes stem 34 that is configured to be translated into and out of cavity 31, as indicated by translation arrow 35. In the example shown, stem 34 has elongated dimensions between end faces 45 that match those of cavity 31. In other examples, the elongated dimension may be less than that of cavity 31, e.g., to enable multiple stems 34 of multiple translatable units 32 to fit end-to-end within cavity 31.

The width of stem 34 between lateral faces 44 may be selected such that the width of stem 34 is less than the width of cavity 31 between lateral walls 30*a*. A clearance between lateral faces 44 and lateral walls 30*a* may be designed to be sufficiently narrow so as to prevent free escape of pressurized fluid through the gap to the ambient atmosphere to maintain a substantially constant fluid pressure at least between proximal face 40 of translatable unit 32 and floor 30*b* of housing 30.

In some cases, at least some of lateral walls 30*a*, lateral faces 44, or both may include (e.g., may be coated with or made from) a material that is configured to reduce or limit sliding friction in case of contact between stem 34 and cavity 31. Other or additional considerations may be taken into account when designing a width of stem 34.

In the example shown, tensioning surface 22 is in the form of a cylindrically convex surface at a distal end of translatable unit 32. Tensioning surface 22 includes a plurality of tensioning pressure openings 38 that are distributed over tensioning surface 22. In the example shown, tensioning pressure openings 38 are arranged along parallel rows along the elongated dimension of tensioning surface 22. In other examples, tensioning pressure openings 38 may be otherwise distributed across tensioning surface 22. The distribution of tensioning pressure openings 38 on tensioning surface 22 may depend, for example, on the thickness of web 12, the tension of web 12, manufacturability or cost considerations, or other considerations. Similarly, the size and shape of tensioning surface 22 may be optimized for a particular application. For example, the size and shape of tensioning surface 22 may depend on available space, manufacturability, cost, or other considerations.

In the example shown, pressure inlet 36 is located at an end of stem 34 of translatable unit 32. Pressure inlet 36 may be connected (e.g., by a standard hose connection) to fluid conduit 25, and thus to pressure source 24. Pressurized fluid that is forced into pressure inlet 36 may flow through internal channels of translatable unit 32 and outward through tensioning pressure openings 38. Therefore, when tensioning surface 22 is translated outward toward web 12, the fluid that flows outward from tensioning pressure openings 38 may form a fluidic cushion between tensioning surface 22 and web 12. The fluidic cushion may then prevent direct contact between tensioning surface 22 and web 12.

In the example shown, proximal face 40 of stem 34 includes proximal pressure openings 42. Similarly, lateral faces 44 include lateral pressure openings 46. Pressurized fluid that is forced into pressure inlet 36 may flow through internal channels and outward via proximal pressure openings 42 and lateral pressure openings 46. The outflowing pressurized fluid may form a region of increased fluid pressure within gaps between an impermeable interior of floor 30*b* and lateral walls 30*a* of cavity 31 and proximal face 40 and lateral faces 44, respectively, of stem 34. The pressure of the fluid in the gaps may be applied to proximal face 40 to push stem 34, and the attached tensioning surface 22, out of cavity 31. The arrangement of proximal pressure openings 42, of proximal pressure openings 42, or both, may be different from the arrangement shown.

The outward pushing of tensioning surface 22 cause tensioning surface 22, e.g., via a fluidic cushion that is formed between tensioning surface 22 and web 12, to apply a pushing force to web 12. The pushing force apply by tensioning surface 22 to web 12 may bend web 12 such that the tension of web 12 may apply an inward counterforce to tensioning surface 22. Thus, tensioning surface 22 may be pushed outward until outward force of the pressurized gas is balanced by the inward force that is applied by the tension of web 12.

The outflowing fluid through lateral pressure openings 46 may act on opposite lateral faces 44. These forces on lateral faces 44 may tend to center stem 34 along a midline of cavity 31. The centering forces may prevent or reduce friction forces that would tend to oppose the translation of translatable unit 32 along the directions indicated by translation arrow 35.

After exiting via proximal pressure openings 42 and lateral pressure openings 46 of translatable unit 32, fluid may flow within the gap between translatable unit 32 and housing unit 30 until reaching the ambient conditions of the environment (e.g., atmospheric pressure). In some applications, a typical clearance between tensioning surface 22 of translatable unit 32 and web 12 is in the range between 0.01 mm and 0.5 mm. The typical clearance between the proximal face 40 of translatable unit 32 and floor 30*b* of cavity 31 is in the range of 0.01 mm and 2.01 mm, depending on the tension in web 12. The typical clearance between each lateral face 44 of translatable unit 32 and an opposite (e.g., facing and approximately parallel to) lateral wall 30*a* of housing unit 30, and between translatable unit 32 and housing unit 30 in all other directions, is in the range of 0.01 mm and 0.5 mm. Clearance ranges may differ for different applications (e.g., different web materials, different fluid pressures, different sizes of components, different constructions of the web tension unit, or other factors that may vary from application to application).

In other examples, lateral faces 44, proximal face 40, or both may lack pressure openings and may be impermeable to fluid flow. In this case, housing unit 30 may include a pressure inlet that is connectable to pressure source 24. For example, inward facing surfaces of lateral walls 30*a*, floor 30*b*, or both, may include pressure openings. Thus, outflowing fluid via the pressure openings in floor 30*b* or lateral walls 30*a* may provide the fluid pressure to force translatable unit 32 outwardly from cavity 31. In other examples, pressure openings may be present on both proximal face 40 and floor 30*b*, on both lateral faces 44 and lateral walls 30*a*, or on other combinations of surfaces. However, in all of these examples, tensioning surface 22 includes tensioning pressure openings 38. The arrangement of pressure openings on any of the surfaces may differ from the arrangement shown.

In some configurations, a length of housing unit 30 may differ from that of translatable unit 32. A length of translatable unit 32 may be longer or shorter than a width of web 12. In some configurations, a single translatable unit 32 may be supported by two or more housing units 30, or a single housing unit 30 may support two or more translatable units 32. Other configurations may be used.

Figure 4:
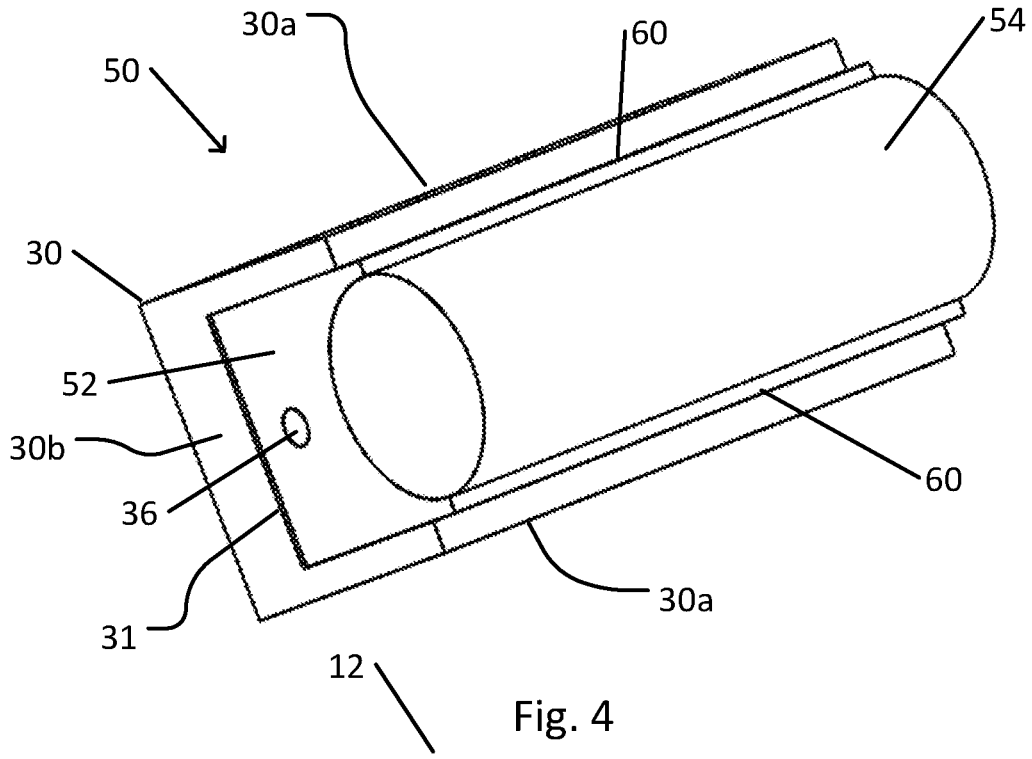
FIG. 4 schematically illustrates an example of a web tension device that includes a roller.
Figure 5A:
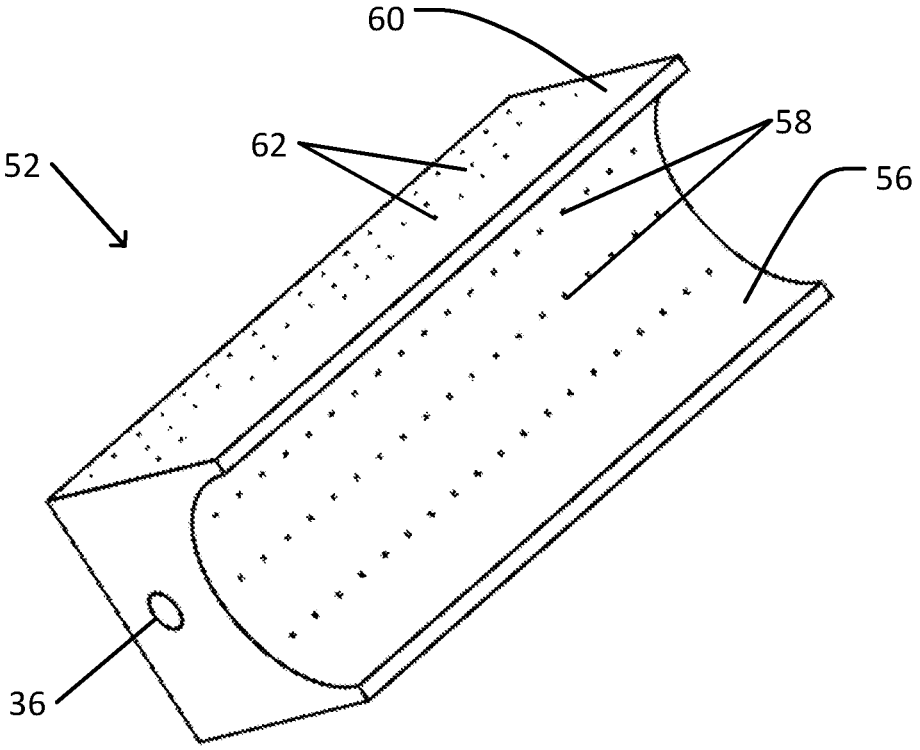
FIG. 5A schematically illustrates a translatable unit of the web tension device shown in FIG. 4.
Figure 5B:
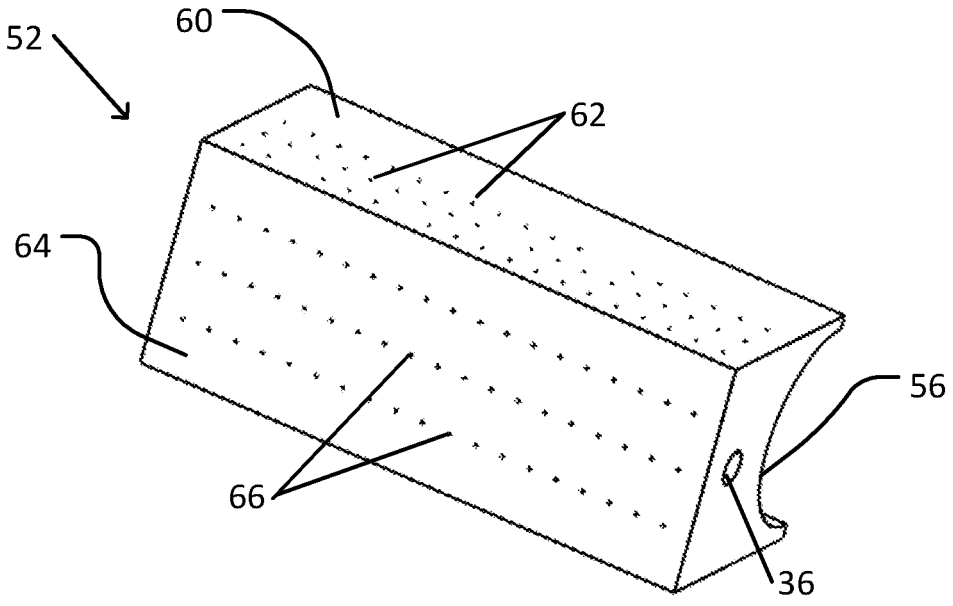
FIG. 5B schematically illustrates another view of the translatable unit shown in FIG. 5A.

FIG. 4 schematically illustrates an example of a web tension device that includes a roller. FIG. 5A schematically illustrates a translatable unit of the web tension device shown in FIG. 4. FIG. 5B schematically illustrates another view of the translatable unit shown in FIG. 5A.

In the example shown, web tension device 50 includes housing unit 30, translatable unit 52, and roller 54.

Translatable unit 52 includes pressure inlet 36 that is connectable to fluid conduit 25, e.g., via a standard hose connection. An arrangement of internal conduits connects pressure inlet 36 with pressure openings on one or more faces of translatable unit 52. The pressure openings include distal tensioning pressure openings 58 on concave tensioning surface 56, and may include one or more of proximal pressure openings 66 on proximal face 64 and lateral pressure openings 62 on lateral faces 60.

Pressurized fluid that is forced into translatable unit 52 via pressure inlet 36 may flow outward via proximal pressure openings 66 on proximal face 64 of translatable unit 52. In addition, pressurized fluid may flow outward via lateral pressure openings 62 on lateral faces 60 of translatable unit 52. The outflowing pressurized fluid may form a cushion of pressurized fluid within cavity 31 between housing unit 30 and translatable unit 52.

Outflowing fluid through proximal pressure openings 66, lateral pressure openings 62, or distal tensioning pressure openings 58, may flow between each face of translatable unit 52 (e.g., proximal face 64, lateral faces 60, or concave tensioning surface 56, respectively) and an opposite surface (e.g., floor 30*b*, lateral wall 30*a*, or roller 54, respectively) until reaching ambient conditions of the environment (e.g., atmospheric pressure). In some applications, a typical clearance between concave tensioning surface 56 and roller 54 may be in the range of 0.01 mm to 0.5 mm. A typical clearance between proximal face 64 of translatable unit 52 and floor 30*b* of housing unit 30 may be in the range of 0.01 mm to 2.01 mm, depending on the tension of web 12. A typical clearance between a lateral face 60 of translatable unit 52 and an opposite (e.g., facing and substantially parallel) lateral wall 30*a* of housing unit 30 (or between another face, e.g., an end face, of translatable unit 52 and an adjacent wall of housing unit 30) may be in the range of 0.01 mm to 0.5 mm. Clearance ranges may differ for different applications (e.g., different web materials, different fluid pressures, different sizes of components, different constructions of the web tension unit, or other factors that may vary from application to application).

A distal side of translatable unit 52 includes concave tensioning surface 56. Typically, the cross-sectional profile of concave tensioning surface 56 is in the form of a circular arc. The radius of concave tensioning surface 56 may be selected to enable roller 54 to fit within concave tensioning surface 56. Concave tensioning surface 56 of translatable unit 52 includes distal tensioning pressure openings 58. When pressurized fluid is forced into translatable unit 52 via pressure inlet 36 when roller 54 is placed within concave tensioning surface 56, outflowing fluid via distal tensioning pressure openings 58 may form a fluidic cushion between roller 54 and concave tensioning surface 56. The fluidic cushion may act to support roller 54 within concave tensioning surface 56 while avoiding direct physical contact, and possible friction, between roller 54 and concave tensioning surface 56.

The outward force that is applied to translatable unit 52 by the fluid pressure of fluid that flows from pressure inlet 36 via internal channels and out through distal tensioning pressure openings 58 on concave tensioning surface 56 may push roller 54 against web 12. The pushing of roller 54 against web 12 may be balanced by the tension of web 12. The fluidic cushion between roller 54 and concave tensioning surface 56 may enable noncontact support of roller 54. Therefore, when web 12 is moved, e.g., from input roll 16 to output roll 18 in the direction indicated by web motion arrow 13, roller 54 may roll without contacting translatable unit 52. Therefore, pushing roller 54 into web 12 may enable controlling the tension of web 12 where the only friction forces that oppose the motion of web 12 are due to the viscosity of the fluid.

For example, if the tension of web 12 is decreased due to a disturbance to web 12 (e.g., as caused by a processing step), a force that is exerted by web 12 on roller 54 in the direction toward housing unit 30 may be reduced, concurrently reducing the fluid pressure in the fluidic cushion between concave tensioning surface 56 and roller 54. Thus, the inward force exerted on translatable unit 52 is also reduced. As a result, the force exerted by the fluid pressure in a gap within cavity 31 between translatable unit 52 and housing unit 30 may push translatable unit 52 outward, increasing the clearance between proximal face 64 of translatable unit 52 and floor 30*b* of housing unit 30. As a result, roller 54 may push web 12 outward, increasing the tension of web 12. The outward pushing may continue until the inward force that is exerted on roller 54 by the increasing web tension is balanced by the outward force on roller 54, and on translatable unit 52, that is exerted by the fluid pressure.

Similarly, if the tension in web 12 increases due to a disturbance of web 12, the inward force that web 12 exerts on roller 54 may increase, causing a momentary increase in fluid pressure in the fluidic cushion between concave tensioning surface 56 and roller 54. Thus, the inward force exerted on translatable unit 52 may increase. The increased inward force may push translatable unit 52 inward into housing unit 30, enabling the tension of web 12 to decrease. The inward pushing of translatable unit 52 may continue until the inward force that is exerted by the tension in web 12 decreases to a magnitude that is balanced by outward forces that are exerted by the fluid pressure on translatable unit 52 and roller 54.

Thus, web tension device 50 may function to maintain an approximately constant tension in web 12.

In other examples, lateral faces 60, proximal face 64, or both may lack pressure openings and may be impermeable to fluid flow. In this case, housing unit 30 may include a pressure inlet that is connectable to pressure source 24. For example, inward facing surfaces of lateral walls 30*a*, floor 30*b*, or both, may include pressure openings. Thus, outflowing fluid via the pressure openings in floor 30*b* or lateral walls 30*a* may provide the fluid pressure to force translatable unit 52 outwardly from cavity 31. In other examples, pressure openings may be present on both proximal face 64 and floor 30*b*, on both lateral faces 60 and lateral walls 30*a*, or on other combinations of surfaces. However, in all of these examples, concave tensioning surface 56 includes distal tensioning pressure openings 58. The arrangement of pressure openings on any of the surfaces may differ from the arrangement shown.

In some configurations, the lengths of two or more of housing unit 30, translatable unit 52, and roller 54 may differ from one another. A length of translatable unit 52 may be longer or shorter than a width of web 12. In some configurations, a single translatable unit 52 may be supported by two or more housing units 30, or a single housing unit 30 may support two or more translatable units 52. Other configurations may be used.

Different embodiments are disclosed herein. Features of certain embodiments may be combined with features of other embodiments; thus certain embodiments may be combinations of features of multiple embodiments. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

The invention claimed is:

1. A web tension device comprising:

a pressure source of pressurized fluid;

a stationary housing;

a translatable unit that is translatable into and out of a cavity of the housing, the translatable unit comprising an inlet that is connectable to the pressure source to enable the pressurized fluid to flow into the translatable unit, a distal end of the translatable unit comprising a tensioning surface with one or a plurality of tensioning pressure openings to enable outflow of the pressurized fluid to form a fluidic cushion, the fluidic cushion to apply a pushing force to a web in a roll-to-roll process; and one or a plurality of proximal pressure openings to enable outflow of the pressurized fluid into a gap between the housing and a proximal end of the translatable unit such that when a tension of the web is reduced, an outward force that is exerted on the proximal end by pressure of the fluid in the gap pushes the translatable unit outward to push the web outward until an inward force that is exerted on the translatable unit by the web balances the outward force, and when the tension of the web is increased, the inward force pushes the translatable unit inward until the inward force is balanced by the outward force, wherein the tensioning surface is concave.

2. The device of claim 1, further comprising a roller, the fluidic cushion configured to suspend the roller.

3. The device of claim 2, wherein the fluidic cushion is configured to apply the pushing force by pushing the suspended roller into the web.

4. The device of claim 2, wherein the tensioning surface is cylindrically concave and wherein the roller is cylindrical.

* * * * *